United States Patent [19]

Radwill

[11] Patent Number: 4,870,914

[45] Date of Patent: Oct. 3, 1989

[54] DIAGONALLY BRACED RAILWAY TRUCK

[75] Inventor: Robert P. Radwill, Burr Ridge, Ill.

[73] Assignee: AMSTED Industries Incorporated, Chicago, Ill.

[21] Appl. No.: 146,379

[22] Filed: Jan. 22, 1988

[51] Int. Cl.[4] ..... B61F 5/50

[52] U.S. Cl. ..... 105/206.2; 105/167

[58] Field of Search ..... 105/165, 167, 168, 182.1, 105/206.1, 157.1, 163.2, 176, 199.1, 206.2

[56] References Cited

U.S. PATENT DOCUMENTS

| | | | |
|---|---|---|---|
| 235,852 | 12/1880 | Browne | 105/165 |
| 2,149,272 | 3/1939 | Cameron | 105/176 |
| 2,347,628 | 4/1944 | Cottrell | 105/208.2 |
| 4,570,544 | 2/1986 | Smith | 105/165 |

FOREIGN PATENT DOCUMENTS

| | | | |
|---|---|---|---|
| 1268174 | 5/1968 | Fed. Rep. of Germany | 105/167 |

*Primary Examiner*—James B. Marbert
*Assistant Examiner*—Joseph D. Pape
*Attorney, Agent, or Firm*—Edward J. Brosius; Charles E. Bouton

[57] ABSTRACT

A diagonally braced railway truck comprising a pair of longitudinal side frames, a bolster extending therebetween and cast support brackets extending downwardly from lower tension members of the side frames and the pedestal jaws. The support brackets have three sides which receive a mounting plate with a precision drilled hole therein to receive the diagonal braces. The mounting plates are connected to flanges on the sides of the support brackets by welding.

6 Claims, 2 Drawing Sheets

DIAGONALLY BRACED RAILWAY TRUCK

BACKGROUND OF THE INVENTION

The present invention relates generally to railway trucks and, more particularly, to a sideframe for use in such truck adapted to receive a plate to hold the diagonal braces.

The so-called three piece railway truck comprising two parallel sideframes with a bolster extended therebetween is well-known. Such truck is utilized in the vast majority of freight car service. Each sideframe usually is comprised of a single cast steel piece having a top compression member, a lower tension member with end pedestals adapted to receive wheel axles which extend transversely between the parallel spaced sideframes. Fabricated sideframes are also known. Vertical internal support columns in each sideframe form a bolster opening. The bolster is usually a cast steel section extending into the sideframe bolster openings and transversely between the spaced parallel sideframes. Each end of the bolster rests on a spring group, the bottom of which rests on the lower tension member of each sideframe. Wedge shaped friction shoes act between the bolster ends and sideframe to dampen oscillation therebetween.

Such three piece railway trucks are well-known for their strength, durability and ability to support great vertical truck loads. However, a weakness of such railway trucks is their inability to restrain themselves from lozenging which is a situation wherein both sideframes remain parallel to each other but one moves slightly ahead of the other. In such a situation the bolster does not remain perpendicular to each sideframe. Such lozenging of the railway truck usually results in truck hunting wherein such displacements can occur in an oscillatory fashion which can be worsened by the resulting contact between wheel flanges and the rails.

One method of attenuating such lozenging is to provide diagonal braces for the railway truck. U.S. Pat. No. 4,570,544 discloses one method for providing diagonal braces to a three-piece railway truck. However, the method shown in such patent relies on a resilient member to connect the diagonal braces to each sideframe. Further, such patent does not disclose details of the bracket connection depending from each sideframe.

Accordingly, it is an object of the present invention to provide an economical means for the diagonally braced railway truck wherein the diagonal or cross braces are solidly and accurately connected to each sideframe.

SUMMARY OF THE PRESENT INVENTION

The present invention provides an arrangement wherein brackets are fastened to the lower tension member of the sideframes as fabrications or cast integrally thereto. Such brackets may comprise a top section with two side sections depending and extending downwardly therefrom. In this case each bracket comprises a generally rectangular receiving slot having two sides and a top. A metal plate having precision drilled circular hole therein can be readily slid against a single flange of the bracket or between double flanges on both side edges and the top edge of the bracket and welded therein. It is desirable to use such a separate receiving plate due to the precision with which the hole can be drilled therein apart from the cast sideframe.

Each bracket is turned at an angle to the longitudinal axis of the sideframe such that, once such sideframes are part of a railway truck, the diagonally opposite brackets are actually parallel to each other. Such an arrangement of diagonally opposite brackets assures that the brace rod between such diagonally opposite brackets is perpendicular to each bracket as it passes through the circular hole therein. Further, a close tolerance can be obtained between the circular hole and the circular diameter brace rod such that a very tight and strong connection is formed between the rod, the receiving plate and the bracket into which such plate is welded.

DESCRIPTION OF THE PREFERRED EMBODIMENTS

Figure 1:
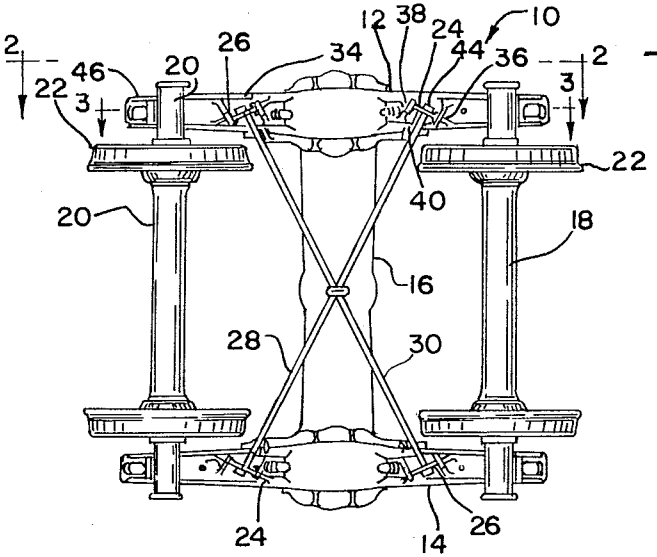
FIG. 1 is a bottom view of a railway truck utilizing the diagonal braces of the present invention.

Referring now to FIG. 1, a railway truck is shown generally at 10. Truck 10 is comprised of parallel spaced sideframes 12, 14. Bolster 16 has ends which extend into bolster openings in each of sideframes 12 and 14. Under ideal operating conditions, bolster 16 is perpendicular to both sideframes 12 and 14. Also extending transversely between sideframes 12 and 14 are axles 18 and 20, each of which support two flanged railway wheels 22. Depending from the lower side of each of sideframes 12 and 14 are brackets 24 and 26. Such brackets are seen to support rod braces 28 and 30. As sideframes 12 and 14 are identical, it is seen that brackets 24 are located on respective sideframes 12 and 14 in a manner such that brace 28 extends between both sideframe brackets 24. Sideframe brackets 26 are similarly located such that brace 30 extends therebetween.

Figure 2:
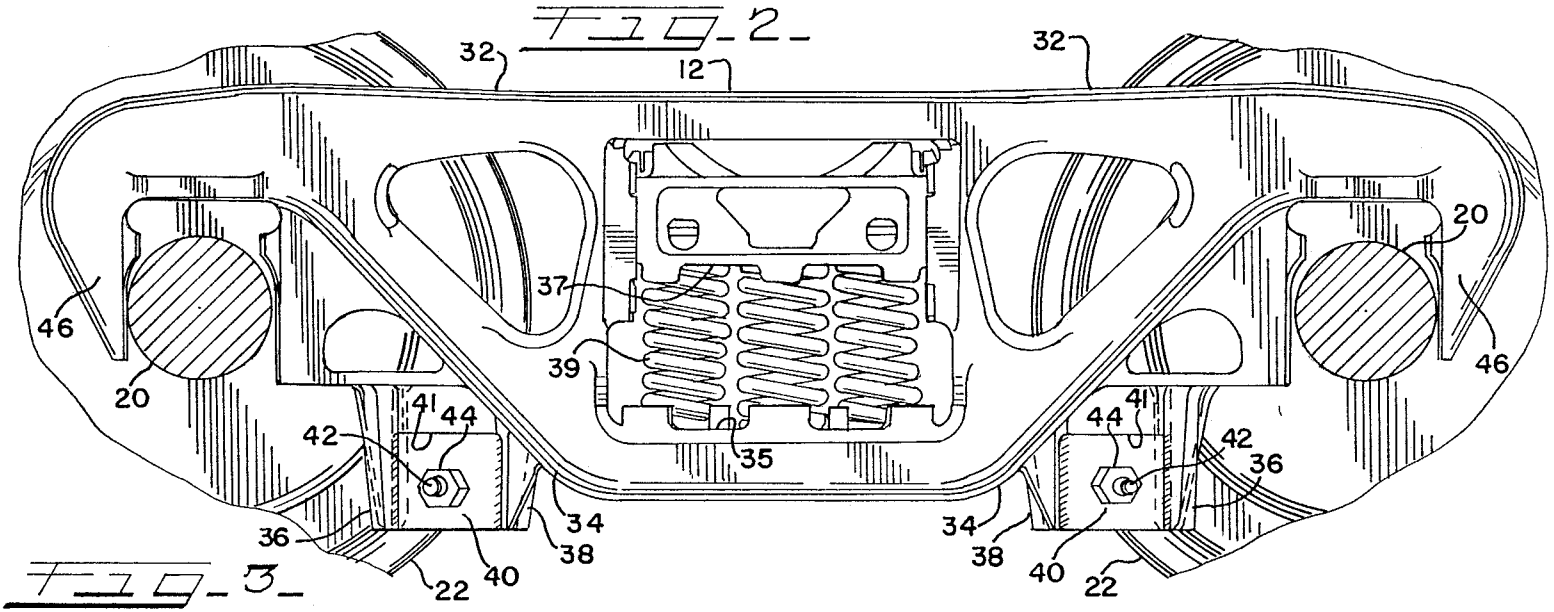
FIG. 2 is a side view of a sideframe of a railway truck embodying the present invention.
Figure 3:
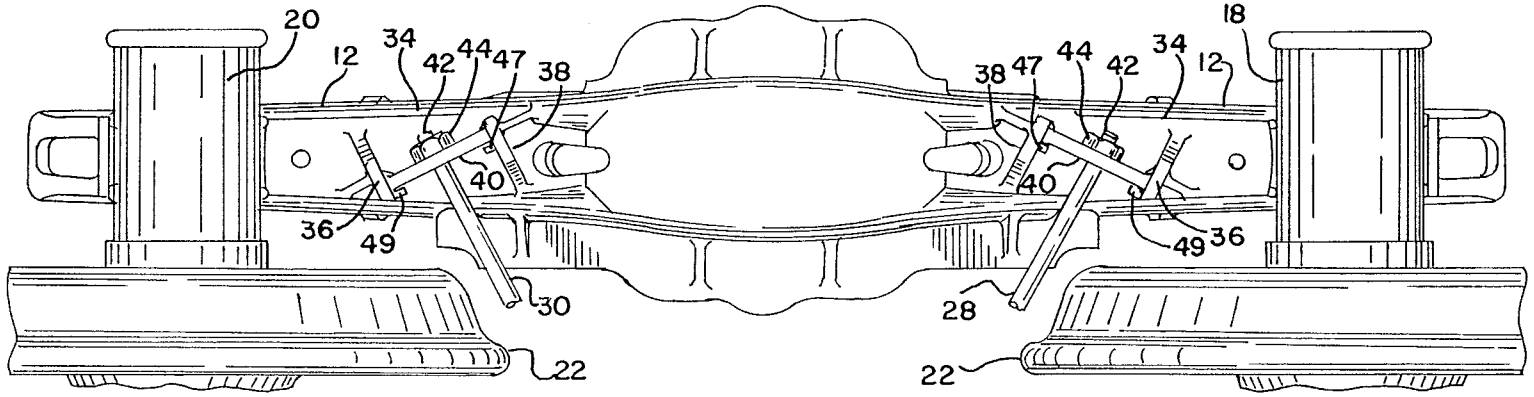
FIG. 3 is a bottom view of a sideframe of a railway truck embodying the present invention.

Referring now to FIG. 2 and 3, a more detailed view of sideframe 12 are shown. Sideframe 12 is seen to comprise elongated top compression member 32 which runs along the entire top length of sideframe 12. Bottom tension member 34 of sideframe 12 includes a bolster opening having a spring seat 35 into which an end 37 of bolster 16 extends. Bolster end 37 is supported on a group of springs 39. Sideframe tension member 34 includes two angled sections running upwardly to connect to top compression member 32. Sideframe 12 also includes a pedestal jaw 46 adapted to receive an end of axle 20 in an appropriate bearing adapter.

Bracket 26 depends from the angled section of sideframe tension member 34. Bracket 26 includes side sections 36 and 38 which together with top section 41 form a generally rectangular slot into which plate 40 is received. Plate 40 is generally rectangular and adapted to snugly fit against side edges 36 and 38. An alternative arrangement would utilize a flange extending from the sideframe.

Figure 5:
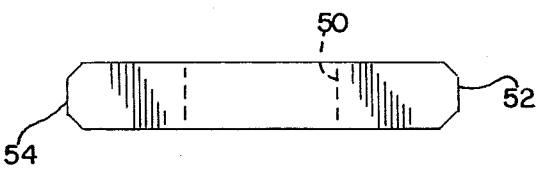
FIG. 5 is a top view of the plate to be received in the bracket in accordance with the present invention.
Figure 4:
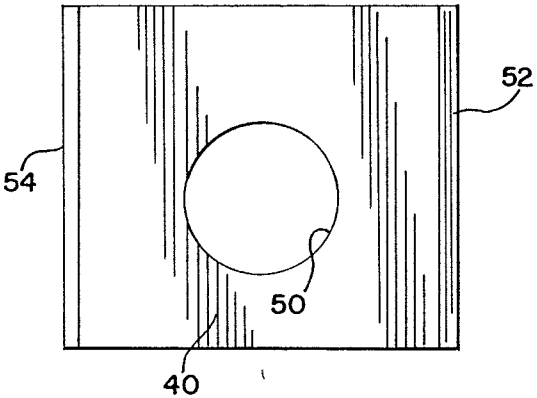
FIG. 4 is a front view of a plate to be received in the bracket in the side frame of the present invention.

Referring now to FIGS. 4 and 5, detailed views of plate 40 are shown. Plate is seen to be generally rectangular plate of sufficient thickness to provide adequate strength to receive diagonal braces which extend into generally centrally located openings 50. Plate 40 is selected of a good quality weldable steel, and opening 50 is precision drilled therein to a dimension slightly greater than the diagonal cross brace which will extend therein. Edges 52 and 54 may have tapered corners, or edge 54 having only one tapered corner such that the flat surface thereof will be received into and against side edge 49. As mentioned above, plate 40 is held by welding against edges 49 and 47 of side supports 36 and 38 of bracket 26.

Figure 6:
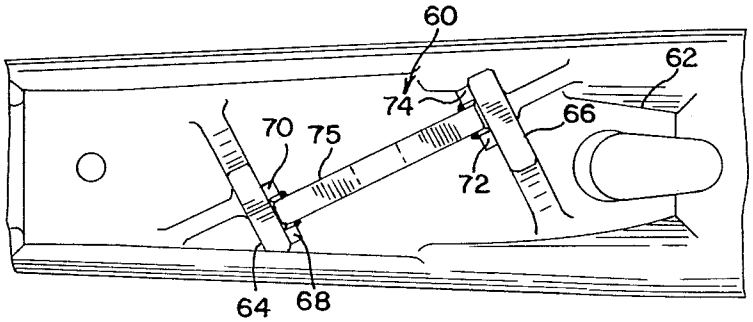
FIG. 6 is an alternative embodiment of a bracket cast or fabricated to a sideframe receiving a plate therein.

Referring now to FIG. 6, a second embodiment of the bracket depending from the lower edge of the angled section of the tension member of a sideframe is shown generally at 60. Sideframe 62 includes bracket section 60 which is formed by side edges 64 and 66 depending downwardly from the angled section of sideframe 62. Flanges 68 and 70 extend inwardly from side edge 64, and flanges 72 and 74 extend inwardly from side edge 66. Together, such flanges form a slot to receive plate 75. Plate 75 is welded therein and is adapted to receive a diagonal brace similar to brace rod 30 described above.

What is claimed is:

1. A sideframe for use in a railway truck, said sideframe comprising a top compression member and a bottom tension member, said bottom tension member having one or more angled sections that extend to and connect to said top compression member and a pedestal jaw, each of said angled sections having a receiving bracket on a lower surface thereof, each receiving bracket comprising an upper edge with two side edges, one side edge depending from said angled section and the other side edge depending from said pedestal jaw, to form a generally rectangular, three sided receiving bracket, and each receiving bracket has a flange extending inwardly of each of the two side edges.

2. The sideframe of claim 1 wherein each receiving bracket has two flanges extending inwardly of each of the two side edges to form a receiving slot therein.

3. The sideframe of claim 1 wherein a plate having a precision drilled circular opening is retained in each receiving bracket.

4. A railway truck comprising two parallel sideframes and a bolster extending therebetween, each sideframe having an upper compression member, a lower tension member, and a pedestal jaw near each end of said sideframe, each tension member including two angled sections extending to and connected to said upper compression member, a bracket comprising two side edges and a top edge to form a generally rectangular, three sided bracket, one side edge depending from said angled section and the other side edge depending from said pedestal jaw, each bracket having a flange extending inwardly of each of the side edges thereof, and said plate received in each bracket is welded to said flanges, a generally flat, generally rectangular plate received in each bracket, each plate having a circular hole therein, two braces each extending between two of said brackets, an end of each brace extending through the circular hole in each plate.

5. The railway truck of claim 4 wherein each bracket has two flanges extending inwardly of each of the side edges thereof.

6. The railway truck of claim 4 wherein each brace is a rod of circular cross section.

* * * * *